US009776096B2

(12) United States Patent
Barber

(10) Patent No.: US 9,776,096 B2
(45) Date of Patent: Oct. 3, 2017

(54) RELATIVE MOTION AMUSEMENT RIDE

(71) Applicant: Gerald L. Barber, Greenville, SC (US)

(72) Inventor: Gerald L. Barber, Greenville, SC (US)

( * ) Notice: Subject to any disclaimer, the term of this patent is extended or adjusted under 35 U.S.C. 154(b) by 0 days.

(21) Appl. No.: 15/201,534

(22) Filed: Jul. 4, 2016

(65) Prior Publication Data

US 2017/0007932 A1 Jan. 12, 2017

Related U.S. Application Data

(60) Provisional application No. 62/188,524, filed on Jul. 3, 2015.

(51) Int. Cl.

| | |
|---|---|
| ***A63G 31/16*** | (2006.01) |
| ***A63G 1/10*** | (2006.01) |
| ***A63G 31/02*** | (2006.01) |

(52) U.S. Cl.

CPC ..... *A63G 31/16* (2013.01); *A63G 1/10* (2013.01); *A63G 31/02* (2013.01)

(58) Field of Classification Search

CPC ..... A63G 31/00; A63G 31/16; A63J 25/00; G09B 9/00

USPC ..... 472/59–61, 130; 434/29–38, 55

See application file for complete search history.

(56) References Cited

U.S. PATENT DOCUMENTS

| | | | | |
|---|---|---|---|---|
| 3,468,533 | A * | 9/1969 | House, Jr. | A63G 31/16 434/34 |
| 4,026,066 | A | 5/1977 | Reiner | |
| 5,622,503 | A * | 4/1997 | Feng | G09B 9/00 434/35 |
| 6,076,638 | A | 6/2000 | Gertz | |
| 6,629,895 | B2 | 10/2003 | Uemura | |
| 7,094,157 | B2 | 8/2006 | Fromyer | |
| 8,151,660 | B2 | 4/2012 | Wood | |
| 8,795,096 | B2 | 8/2014 | Stoker | |
| 8,888,185 | B2 | 11/2014 | Liao | |
| 9,004,921 | B2 | 4/2015 | Garvis | |
| 9,186,590 | B2 | 11/2015 | Lee | |
| 9,353,903 | B2 | 5/2016 | Kang | |
| 2008/0146356 | A1 | 6/2008 | Gaughan | |
| 2015/0018107 | A1 | 1/2015 | Kaastra | |

* cited by examiner

*Primary Examiner* — Kien Nguyen

(74) *Attorney, Agent, or Firm* — McNair Law Firm, P.A.; Douglas W. Kim

(57) ABSTRACT

This invention is a relative motion amusement ride comprising having an inner compartment with a rider's area, a rotational drive and vertical drive attached to the inner compartment, a set of light panels disposed along an inner wall of the rider's compartment and along the perimeter of the rider's area; a light panel controller in communications with a database of images and computer readable instructions for displaying images on the set of light panels and door light panel wherein such display is cooperatively associated with the motion of the rider's compartment to coordinating the physical movement of the inner compartment and the image on the light panels to provide relative motion to the rider; an inner speaker for providing audio information in the rider's area wherein the audio information is coordinated the physical movement of the inner compartment and the image on the light panels.

15 Claims, 7 Drawing Sheets

RELATIVE MOTION AMUSEMENT RIDE

BACKGROUND OF THE INVENTION

1) Field of the Invention

The present invention relates to an amusement ride. More specifically, the invention relates to a mobile or stationary amusement ride utilizing frame or reference and relative motion to provide the rider with an enhanced experience of motion.

2) Description of Related Art

In the United States, it has been estimated that over 500 million guests visit carnivals, fairs, amusement parks and festivals each year. It is estimated that over half of these guests participate on amusement rides. These rides are offered by carnival organizers and vendors that can purchase or rent the rides. Rides that involve motion such as bumper cars, carousels, roller coasters, free falls, ferris wheels, and the like, can have prices that exceed $150,000. In many cases, these costs are prohibitive to the operator or vendor. However, the rides that involve motion can be the most popular rides and therefore the one with the largest revenues. Additionally, the motion rides can be a draw for guests resulting in increased attendance to the carnival, fair, or festival.

One undesirable effect of these larger motion rides is that over time, the popularity of the ride declines, especially in amusement parks. As such, the revenue curve of the ride will decrease over time. As the rides are typically constructed from metal with very specific designs and construction (e.g. ferris wheel), the ability to refresh the ride is either impossible or very limited.

Additionally, the carnivals, fairs, and festivals are schedule for limited periods of time. The vendors and operators travel from location to location, based upon the schedule and booking, to transport and operate various rides to multiple locations throughout the year. The rides need to be able to be transported in one embodiment using the typical highway and interstate road systems. Traditionally, this requires that the rides be erected which can take up to two days. One vendor has stated that it requires 75 full time employees and an additional 20-30 local employees to erect all rides in a carnival. During this set-up (and take-down) time, revenues are not being generated.

By way of background, the present invention utilizes the effect of relative motion and the rider's frame of reference to provide for a physical experience to the user. Relative motion is the calculation of the motion of an object with regard to some other moving object. It is just that, motion relative to another object. Relative motion is a concept, and its calculation occurs with relative velocity, relative speed, or relative acceleration. The other object is part of the rider's frame of reference. The frame of reference is an abstract coordinate system and the set of physical reference points that uniquely fix (locate and orient) the coordinate system and standardize measurements. It involves the relationship between a moving observer and the phenomenon or phenomena under observation (i.e. observational frame of reference). When an individual believes that the frame of reference is stationary, the observation of motion to the individual results in the user believing that the object in motion is the object moving. However, when the individual believes that the frame of references is stationary and in fact it is not, the individual perceives that the individual is moving when in fact the individual is not.

For example, when a driver of a stopped vehicle is focused on an adjacent vehicle, such as at an intersection, the adjacent stopped vehicle can be the frame of reference. If the adjacent vehicle begins to move forward, the driver, expecting the adjacent vehicle to be stationary, can believe that the driver's stopped vehicle is in fact moving forward. This occurs when the driver expects the frame of reference to have a static state when in fact it does not.

Therefore, it is an object of the present invention to provide a cost effective ride that provides the rider with the experience of enhanced motion.

It is another object of the present invention to project the rider's experience to potential riders.

It is another object of the present invention to provide for an amusement ride where the rider's experience can be modified to allow the rider to continue to experience the "first time" feeling.

It is another object of the present invention to provide for an amusement ride with minimal set-up time.

It is another object of the present invention to provide for an amusement ride that is transportable on highway and road systems.

SUMMARY OF THE INVENTION

The above objectives are accomplished according to the present invention by providing a relative motion amusement ride comprising: a trailer if it is a portable version, a rider's compartment carried by the trailer; an inner compartment included in the rider's compartment that can rotate and travel vertically within an outer compartment included in the rider's compartment; a plurality of light panels carried by the interior walls of the outer compartment for displaying an image that can be viewed through the transparent or semi-transparent walls of the inner compartment; a computer readable medium connected to a slewing (rotational) and vertical drive that has computer readable instructions for actuating the slewing (rotational) and vertical drive, determine the speed and acceleration of the inner compartments perimeter, and actuating the light panels to display an image that can be perceived to move in relation to the motion of the perimeter of the inner compartment by matching the speed, acceleration, and direction or modifying the speed, direction or acceleration to provide a rider with perceived or relative motion differing from that of the actual physical motion of the inner compartment. In one embodiment, the floor plate can be stationary and the invention implemented without the trailer.

The invention can include a rider's compartment carried by a trailer; an inner compartment included in the rider's compartment; a slewing assembly attached to the inner compartment configured to rotate a rider's area defined by the inner compartment; a vertical motion assembly attached to the inner compartment and configured to allow the rider's area to travel vertically relative to the trailer; an inner door carried by the inner compartment configured to allow access to the rider's area; an outer door attached to the rider's compartment configured to allow access to the inner compartment; a set of light panels disposed along an inner wall of the rider's compartment and along the perimeter of the rider's area configured to display images inward toward the rider's compartment; a door light panel attached to the outer door configured to display images inward toward the rider's compartment; a light panel controller in communications with a database of images and computer readable instructions for displaying images on the set of light panels and door light panel wherein such display is cooperatively associated with the motion of the rider's compartment to coordinating the physical movement of the inner compartment and the image on the light panels to provide relative motion to the rider; an inner speaker carried by the rider's compartment for providing audio information in the rider's area wherein the audio information is coordinated with the physical movement of the inner compartment and the images on the light panels; a microphone configured to receive audio information generated within the rider's area; an outer speaker for broadcasting audio information recorded by the microphone; a video camera configured to capture video information generated within the rider's area; an attractor display carried by the trailer for projecting video information captured by the video camera external to the rider's compartment; a set of extensions carried by the trailer; and, a set of coverings carried by the trailer and attached to the extensions to conceal at least a portion of the rider's compartment.

The invention can also include a transparent wall encircling the rider's area allowing riders to view the images on the light panels from the rider's area, an entryway allowing riders to enter the rider's area, a ramp to stairs to assist with entering or exiting the rider's area, and a folding ramp allowing riders to enter the rider's area.

The invention can include a vertical drive disposed beneath the inner compartment and extending through the rider's compartment to provide vertical motion to rider's area and the vertical drive can include a worm gear. A center post can be included wherein the inner compartment travels vertically about the central post. An inner microphone can be included an configured to capture audio information generated within the rider's area; and, an outer speaker can be carried by the trailer for broadcasting audio information captured by the inner microphone external to the rider's component.

A well can be included in a lower portion of the trailer wherein the rider's compartment is disposed in the well.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits, and advantages of the present invention will be apparent from this summary and certain embodiments described below, and will be readily apparent to those skilled in the art. Such objects, features, benefits, and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Figure 1:
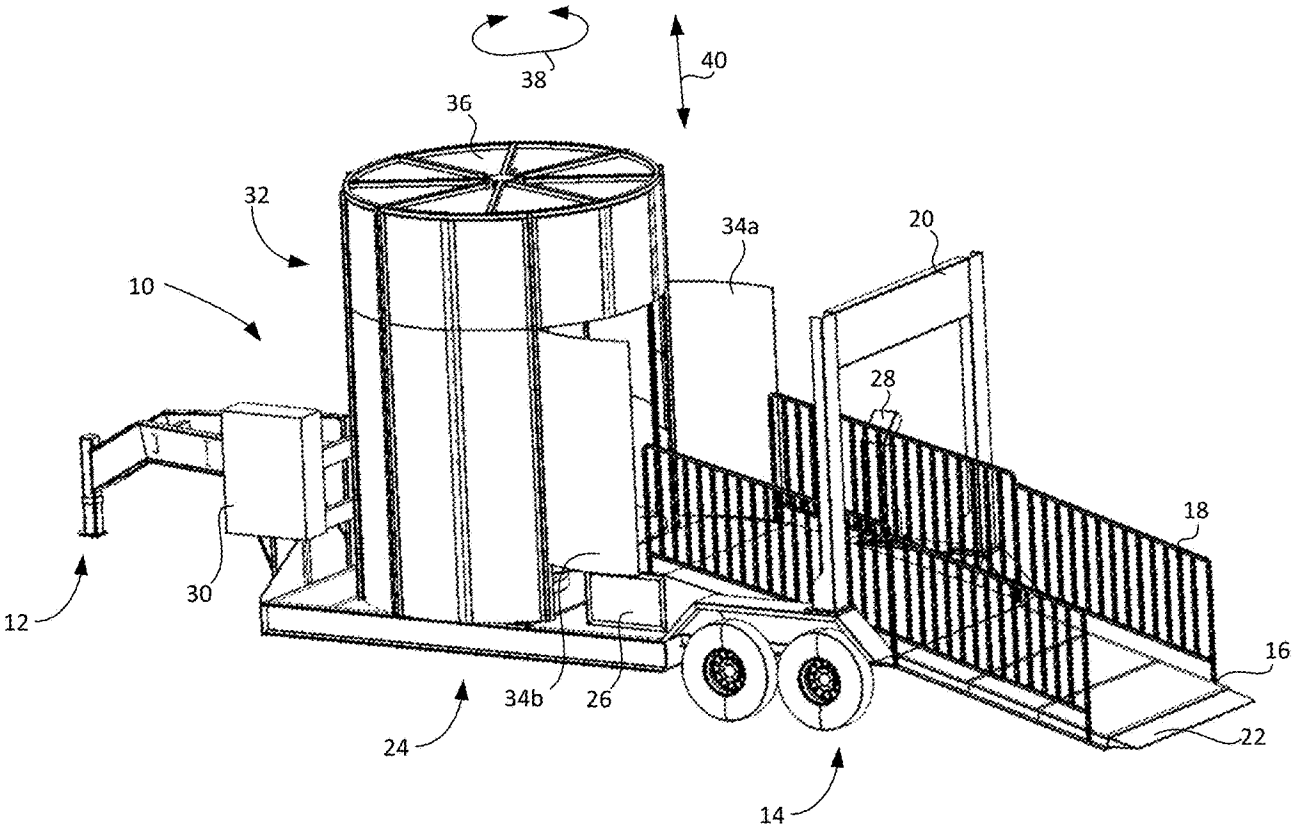
FIG. 1 is a perspective view of aspects of the invention.

Referring to FIG. 1, the invention includes a trailer 10 with a hitch 12 and wheels 14. The trailer can include a ramp 16 which can be fixed or retractable. A entrance ramp and exit ramp can both be attached when two ramps are configured. Hand rails 18 can be included laterally on the ramp. Signage and other attractors can be disposed above the ramp such as on an arch 20 for viewing by rider's and potential rider's. The trailer can be foldable so that it can be placed in a storage configuration for transport and storage where the ramp is contained within the footprint of the trailer. The ramp can subsequently be placed in an operational position where the ramp extends beyond the footprint of the trailer. The ramp can include a leading portion 22 that is attached to the ramp and provides for a smooth transition from the ground to the ramp.

The trailer can include a well 24 that is defined in a lower portion (drop) in the trailer. The drop can hold a utility box 26. The operator's control panel 28 can also be attached to the trailer and can be attached to the well and electronically connected to the utility box. A second utility box 30 can be attached to the trailer. In one embodiment, a utility box can contain the power supply connections, controllers (e.g. PLC) wiring, relays, and the like, for operation of various motors and drives of the present invention. A utility box can also include a computer readable storage medium, computer readable instructions and the like, specifically for controlling light panels as described herein.

The rider's compartment 32 can be attached to the trailer and can be disposed in the well. The rider's compartment can include one or more doors 34*a* and 34*b*. The doors can be inner doors for allowing access to an inner compartment that includes a rider's area for receiving riders. The doors can include outer doors in the rider's compartment allowing access to the inner doors. The doors can be inner door an outer doors. A roof 36 can enclose the rider's compartment and define a rider's area within the rider's compartment. In one embodiment, the rider's compartment has a height less than 14 feet. The rider's compartment can be generally circular. Portions of the rider's compartment can be rotated circularly in a direction shown as 38, vertically in a direction shown as 40 or a combination. In one embodiment, portions of the rider's compartment can be rotated 360° and travel vertically in the range of 0 to 4 feet.

Figure 2:
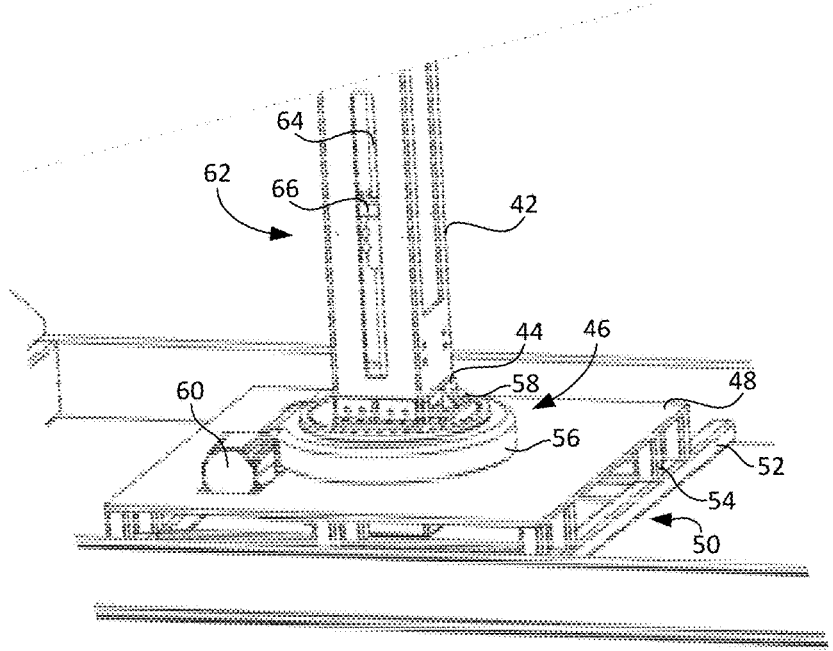
FIG. 2 is a perspective view of aspects of the invention.

Referring to FIG. 2, aspects of the rider's compartment is shown with a center post 42. The center post 42 can be attached to a post base 44. The post base can be attached to a rotational drive. In one embodiment, the rotational drive is a slewing assembly having a slewing bearing 46 which can be attached to a floor plate 48. The post base allows for sufficient clearance above the floor plate for the slewing bearing and the slewing drive 60. The floor plate can be supported above the trailer, as well as by a base support assembly 50 that includes cross members 52 and risers 54. The slewing bearing can include a ring 56 that can be rotated independently of the slewing bearing housing 58. When ring 56 rotates, the post also rotates. The slewing assembly can include a slewing drive 60 is operatively connected to the slewing bearing so that when the slewing drive is engaged, ring and therefore post, rotate. The slewing drive and slewing bearing allow the rider compartment and post to rotate about a long axis of the post. In one embodiment, the slewing drive is a worm gear.

Figure 3:
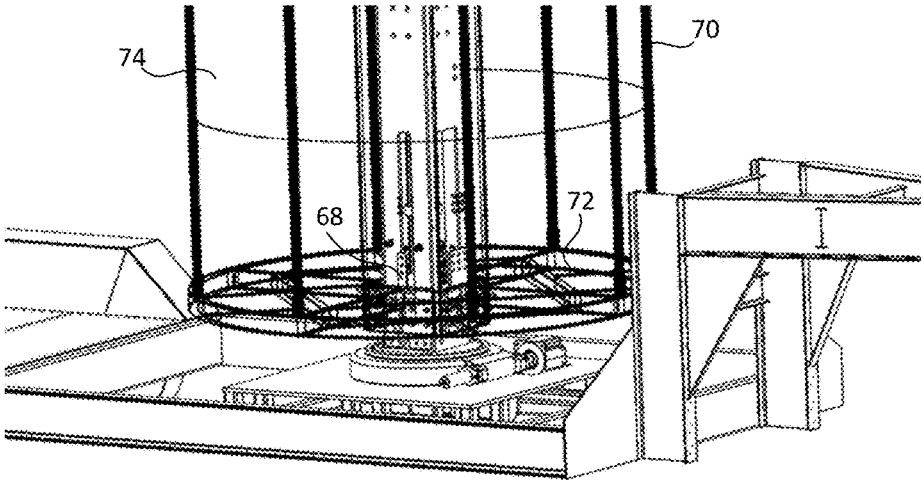
FIG. 3 is a perspective view of aspects of the invention.

A vertical motion assembly 62 can be carried by the post. The vertical motion assembly can include a shaft 64 and lift 66. The lift can travel vertically along the shaft. Referring to FIG. 3, attachment brackets 68 can connect to an inner compartment 70 (shown transparent). The inner compartment can include an inner floor 72 for supporting riders. The inner compartment and inner floor can be moved vertically by the vertical motion assembly and can rotate along with the post thereby subjecting the rider to vertical and circular motion. The walls 74 of the inner compartment can include transparent walls disposed at its perimeter for containing riders in the rider's area while allowing the rider to see images on the light panels through the walls.

Figure 4:
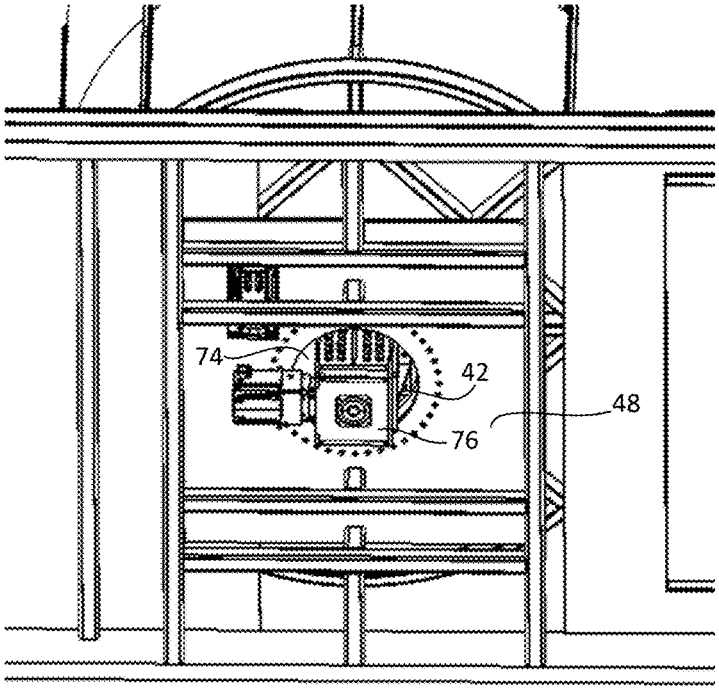
FIG. 4 is a perspective view of aspects of the invention.

Referring to FIG. 4, the post 42 is shown extending through the floor plate 48 through opening 74. A vertical drive 76 can be attached to the lower end of the post and operatively connected to the vertical motion assembly so that when the vertical drive is engaged, the vertical motion assembly causes the inner compartment to move vertically. In one embodiment, the vertical drive is a worn gear. By having the post extend through the floor plate, the vertical drive can rotate with the post with sufficient clearance and provide vertical motion when the inner compartment is rotating.

Figure 5:
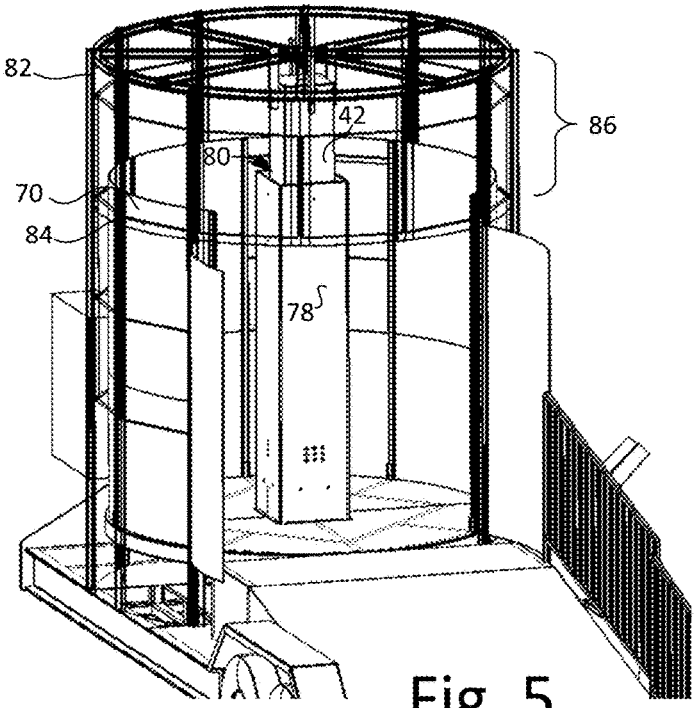
FIG. 5 is a perspective view of aspects of the invention.

Referring to FIG. 5, the inner compartment 70 is shown with a center post 78 that includes a center opening 80 for receiving post 42. The confirmation allows the inner compartment to travel vertically about post 42. An outer compartment 82 (shown transparent) is carried by the trailer and generally surrounds the inner compartment. The inner compartment includes doors that can be opened allowing access to the interior of the inner compartment where riders are positioned. In one embodiment, handrails can be included disposed about the interior of the inner compartment. In one embodiment, enhancement effects such as smoke, sounds, and the like, can be included inside the rider's compartment.

Light panels 84 are disposed between the walls of the inner compartment and the inner walls of the outer compartment. When the riders are positioned in the inner compartment, and because the walls of the inner compartment are transparent, the rider's frame of reference is that of the light panels. The light panels can be LED panels with hundreds or more of individual lights emitting diodes, each of which can be programmed to display uniquely. The light panels can include liquid crystal display (LCD) displays, light-emitting diodes (LED) displays, plasma displays, organic light emitting diode (OLED), interferometric modulator display (IMOD), or other display device that can display, project or reflect colors and images to the rider.

The image displayed on the light panel can include a traveling image. For example, if the light panel is displaying vertical bars, the vertical bars can be stationary around the circumference of the inner compartment. The frame of reference of the rider would thereby be in relation to the static position of the vertical lines. The light panels can then be programmed to have the vertical lines projected in sequence along a circular route providing the illusion that the vertical line is travelling around the circumference of the inner compartment when the inner compartment is stationary. When the light panels are programmed to have the image be perceived to be traveling around the circular route, the inner compartment can be rotated to match the speed of the image of the light panels so that the rider perceives that the rider is not moving. The speed of the image traveling around the light panels can be equal to, faster than, or slower than the physical rotation of the inner chamber to provide to the rider the perception that the rider is moving faster or slower than the actual physical movement. By coordinating the physical movement of the inner compartment and the image on the light panels, the rider can experience perceived motion that is not equal to the actual motion.

Using another example, if the light panel is displaying horizontal bars, the horizontal bars can be stationary around the circumference of the inner compartment. The frame of reference of the rider would thereby be in relation to the static position of the horizontal lines. The light panels can then be programmed to have the horizontal lines projected in sequence, vertically up or down. The light panels provide the illusion that the horizontal line is travelling vertically along the circumference of the inner compartment when the inner compartment is stationary. When the light panels are programmed to have the image perceived to be traveling vertically, the inner compartment can be vertically moved to match the speed of the images of the light panels so that the rider perceives that the rider is not moving. The speed of the image traveling along the light panels can be equal to, faster than, or slower than the physical vertical motion of the inner chamber to provide the rider the perception that the rider is moving faster or slower than the actual physical movement.

Light panels can be disposed from the inner compartment floor and extend to the top of the inner compartment. The light panels can be so that they are generally contiguous around the circumference of the inner compartment. The doors of the outer compartment can include light panels so that when the doors of the inner compartment and the outer compartment are closed, the light panels can project an image seamlessly around the inner compartment. The outer compartment can extend a distance 86 above the top of the inner compartment allowing sufficient clearance for the inner compartment to travel vertically within the outer compartment. The area between the top of the inner compartment and the outer compartment roof can be dark, light natural, light absorbing or black so as not to detract from the image being emitted from the light panels. Each light panel can include its own light panel controller. The display controller can be in communication with a central controller. The central controller can coordinate each light panel to display an image that can appear to travel from one light panel to another.

Figure 6:
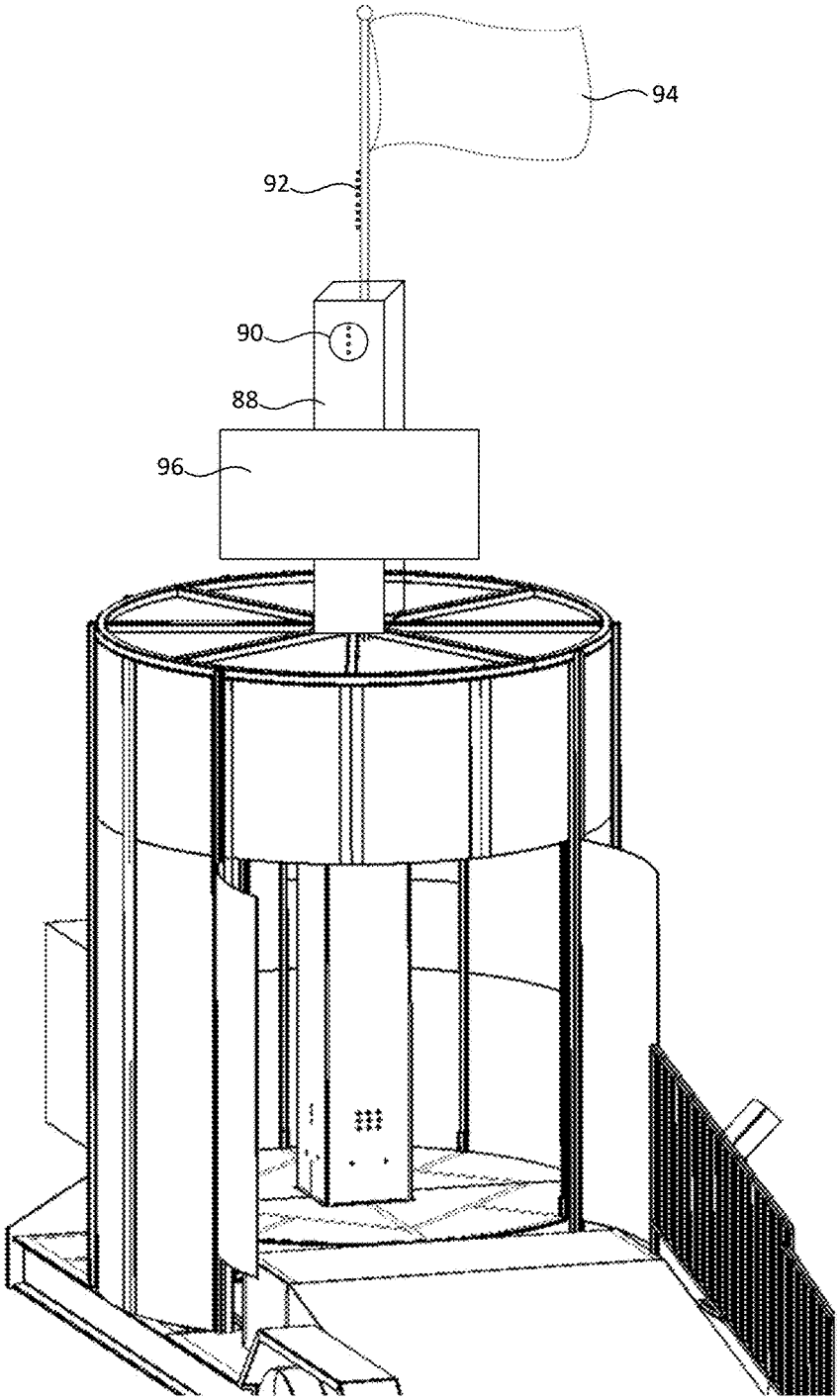
FIG. 6 is a perspective view of aspects of the invention.

Referring to FIG. 6, the outer compartment is shown with the door open allowing the rider to enter or exit the inner compartment. In one embodiment, an external post 88 can be attached to the outer compartment and can carry an outer speaker 90. The speaker can broadcast the sounds captured with a microphone 103 (FIG. 7) in the inner compartment from the rider and project these sounds as an attractor to potential riders. The external post can also carry lights 92, flags and banners 94 and other attractors. In one embodiment, a video camera can be disposed within the rider's compartment and captured video of the riders can be can transmitted to an attractor display 96 that can be carried by the external post or otherwise disposed outside the ride's compartment. Other attractor messages can be displaced on the exterior post. In one embodiment, the attractors such as the flag, lights, speakers, and display can be carried by arch 20 (FIG. 1).

Figure 7:
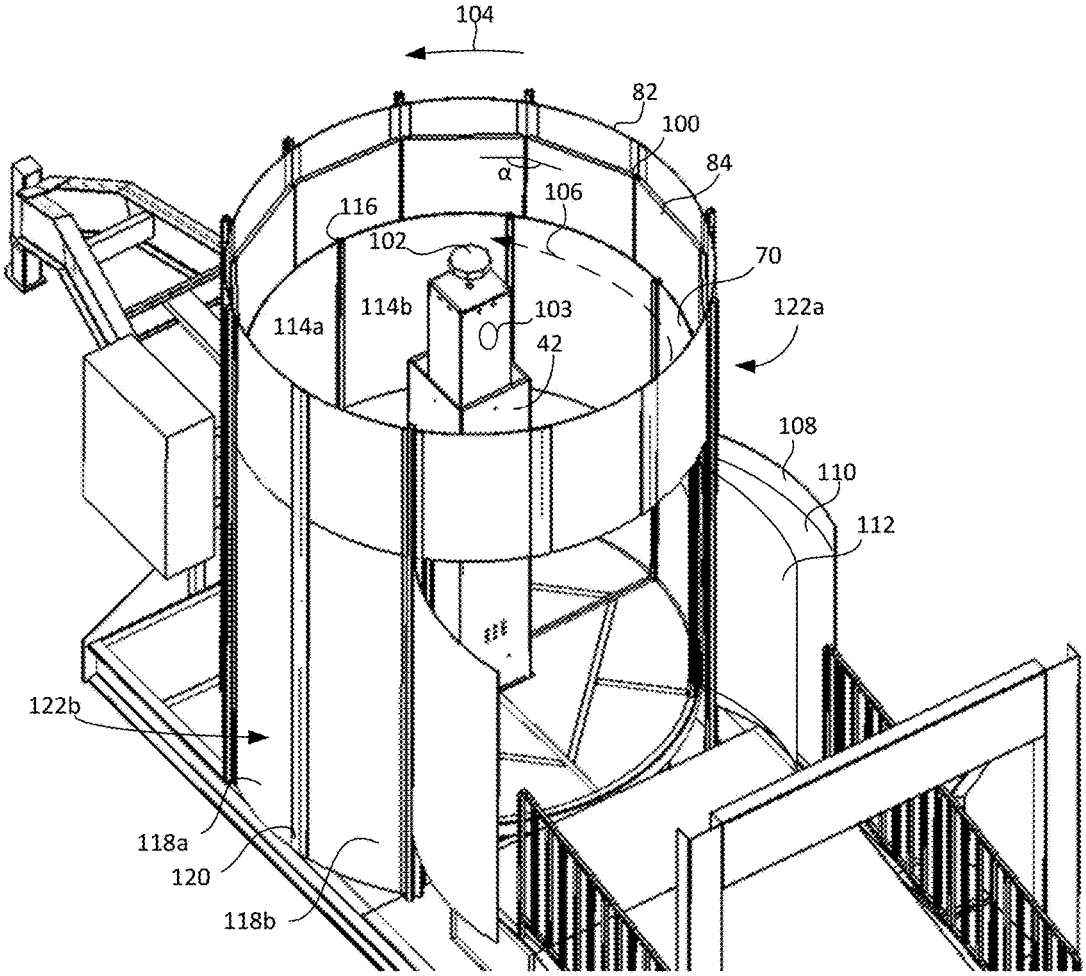

Referring to FIG. 7, the rider's compartment is shown with the roof removed. The outer compartment 82 is shown carrying the light panels 84. The light panels can be arranged generally abutting along their vertical edges 100, to form a generally continuous light or image display wall that encircles the wall of the inner compartment 70. The light panels can be arranged to form angle $\alpha$ where $\alpha$ is less than 180° allowing the light panels to encircle the inner compartment. The post 42 can have a bearing 102 that is carried by the outer compartment or roof to assist with stability of the post while allowing the post to rotated within the rider's compartment. The center post can include an inner speaker to provide audio information to the riders in the rider's area. The audio information can be coordinated the physical movement of the inner compartment and the image on the light panels so that relative motion is enhanced. For example, when the images and the motion of the rider's area provides the sensation of falling, the audio information can have the sound of wind that represents an increase in velocity to be cooperatively associated with the falling relative motion experience.

In one embodiment the inner compartment can be constructed of inner panels such as 114*a* and 114*b*. The panels can be connected to an inner compartment frame 116 so in the event of the need to repair, the individual panels can be repaired or replaced without the need to replace the entire inner compartment. The outer compartment can be constructed of outer panels such as 118*a* and 118*b*. The panels can be connected to an outer compartment frame 120. There can be panel sections such as a top section 122*a* and a bottom section 122*b*.

In order to allow the riders to enter and exit, the inner compartment and the light panels provides for an 360° visual experience with displayed images, outer compartment door 108 can have a light panel 110 attached to it so that when the outer compartment door is closed the light panel is adjacent to the light panels disposed against the inner walls of the outer compartment. The inner compartment door 112 can be closed prior to closing the outer compartment door so that the transparent inner door allows the rider to see the displayed image, but does not allow contact with the light panel.

As the inner compartment rotates in a direction shown as 104, the light panels can generate an image that travels along path 106 at the same speed as the physical rotation of the inner compartment at its outer perimeter. While the rider may feel the motion of the inner compartment, the visual effect would be that the inner compartment is stationary. As the image increases in speed to that greater than the inner compartment, the rider's perception will be that the rider is accelerating. Therefore, the rider experiences the thrill of acceleration without actually, necessarily, having the corresponding physical movement. When the inner compartment rotates and moves vertically (including varying acceleration and velocity), the light panels display image with a perception of motion. These effects results in an vastly large number of combinations of motion and displayed images thereby providing a relative motion experience to the rider.

In operations, the computer readable insertions can control the motion of the inner compartment and the light panels, and therefore can control the relationship between the speed and direction of the inner compartment as the speed and direction of the image as it is displayed along the light panels. The computer readable instructions can synchronize the inner compartment with the displayed image or offset the motion of the inner compartment with the displayed image to produce an infinite number of perceptions for the rider.

In one embodiment, the ride can be a fixed number of seconds, 120 for this example. The ride time can be divided into discrete sections, such as 8 blocks of 15 seconds. The ride can start with a sudden physical motion upwards resulting from an actuation of the screw jack with the light panels displaying an image that is "rushing" downward. The upward motion can be a 1 second jerk and 7 second slower motion upwards. This provides the rider with the perception of the rider being accelerated upwards (1 second) and then continues to be pulled upwards (7 seconds). The second block can include a sudden one second clock wise rotation followed by a seven second slow rotation. Contemporaneously with the physical motion, the light panels are displaying an image that is rotating counter-clock wise to provide the perception of spinning. This sequence can be varied to provide for different perceptions of vertical and rotational accelerations. Portions of the sequence can be reversed so that the rider is provided with the perception of falling or falling and spinning.

Figure 8:
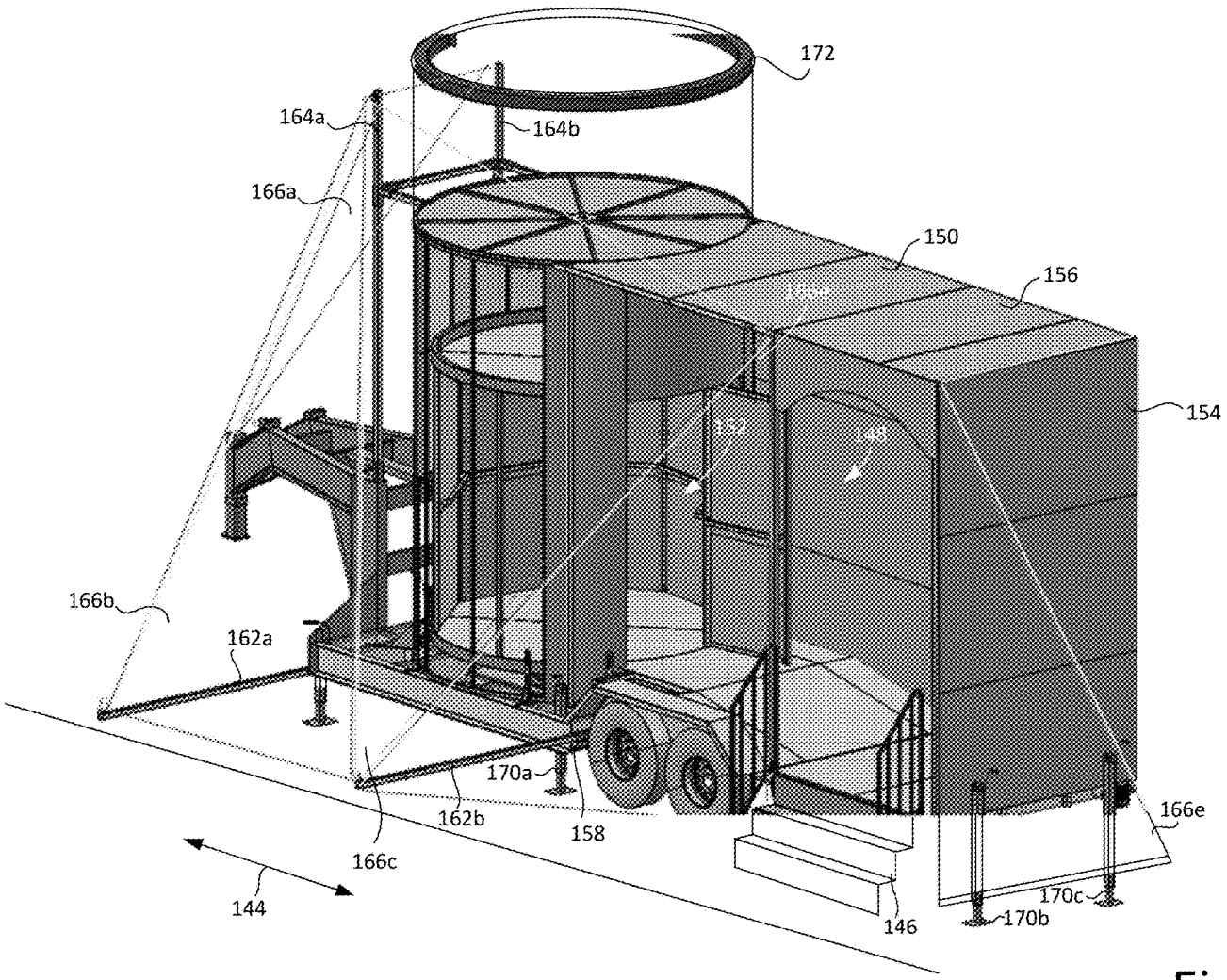
FIG. 8 is a perspective view of aspects of the invention.

Referring to FIG. 8, the invention is shown in a horizontal configuration lengthwise along the travel path 144 of the midway to maximize the area of the invention presented to the potential riders. The opening 148 for entering and exiting the invention is shown on the long side of trailer 10. Steps 146 can be included at the side opening 148. An entryway 150 can precede the rider's compartment opening 152 and include walls 154 and roof 156. The entryway can include an entrance opening and an exit opening allowing for easier flow of riders into and out of the rider's compartment.

Generally, it is desirable to have the frame, entryway and rider's compartment concealed from view of potential rider to increase the mystery and enhance the rider's experience. The trailer can include a plurality of extensions that can assist in the concealment. The extension can be attached to the trailer or to an extension frame 158 that can be attached to or otherwise carried by the trailer. The extensions can be used to hold coverings that provide concealment. A rider's compartment roof 160 can be included that can be disposed above the rider compartment and extend upwards. The trailer can include stabilizer members 170*a* through 170*c* to level the trailer in the event the support ground in uneven.

In one embodiment, front extensions 162*a* and 162*b* can be included that extend forward away from the rider's compartment. Vertical extensions 164*a* and 164*b* can be extended vertically. Coverings can be attached to the extensions, trailer, entryway, or any combination. In one embodiment, the covering can be arranged so as to conceal the support structure of the invention. Front covering 166*a* (shown transparent) can be generally a triangle shape having a vertice attached to the trailer and the base attached to the vertical extensions. The covering can be printed with colors or images and conceal portion of the support structure and invention components. A main covering 166*b* can have a vertice attached to a vertical extension and the base attached to front extensions. A first intermediate covering 66*c* can have a vertice attached to the front extension and the base attached to the vertical extension, entryway or both. A second intermediate covering 166*d* can have a vertice attached to the entryway and the base attached to the trailer, stairs, front extension, entryway or any combination. A side covering 166*e* can have a vertice attached to the entryway and the base attached to the trailer, side extensions, stairs, stabilizing members a cross bar attached to the trailer, extensions, stabilizing member or any combination.

The rider's compartment can include a top frame 172. The top frame can enclose components of the invention. The coverings can also be attached to the top frame. The top frame can be circular in one embodiment. Extension can be attached to the top frame and the entryway to provide concealment and attachment points to the coverings or attractors for the invention.

The covering can be of a material such as canvas, vinyl, natural or synthetic fabric, or other material than can be stretched and will maintain its shape. The material can include physical properties including resistant to weather wear, UV damage and resist damage due to multiple cycles or installation.

Figure 9:
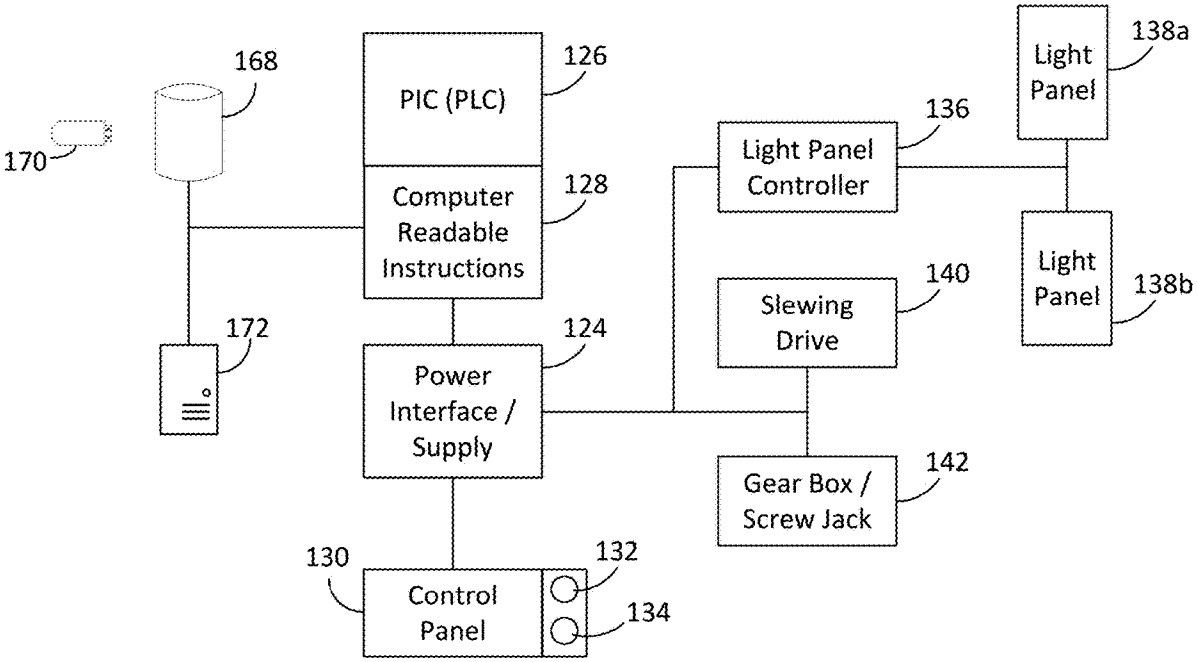
FIG. 9 is a schematic of the invention.

Referring to FIG. 9, the invention can include a power supply or power interaction to an external power supply 124. The power supply can be a generator or can be connected to an existing power. The power supply can provide power to a computer system such as a Programmable Industrial Computer (PIC) or Programmable Logic Computer (PLC) 126 that can include a computer readable medium 128, processor and memory. The PIC or PLC, computer readable medium, processor and memory can be part of a special purpose computer designed to provide aspects of the structure and functionality of this invention. The PIC/PLC can be programmed with an external interface that connects to the PIC/PLC or can have computer readable instructions downloaded to the PIC/PLC.

A control panel 130 can be connected to the PIC/PLC to allow an operator to start the ride using either a touch screen or ON button 132. The ride can be stopped with a STOP button 134. The PIC/PLC can be connected to the central controller 136 that can in turn be connected to the light panels such as 138*a* and 138*b*. The light panels can include their own light panel controller (sub-controller) that control each lights panel with the central controller coordinating the images displayed on the various light panels through the sub-controllers.

The PIC/PLC can also be connected to the slewing assemble 140 and the vertical motion assembly 142. Drive controllers can be included to communication with the PIC/PLC and based upon the instructions received from the PIC/PLC, actuate the drives of the slewing assemble and vertical motion assembly. The components including the PIC/PLC and the control panel can be weather proof for outdoor operating environments. The PIC/PLC can be disposed at or near the goose neck of the trailer while the control panel can be disposed closer to the doors of the outer compartment or the ramp.

The PIC/PLC can be attached to an audio controller that broadcasts audio information in to the rider's compartment. The PIC/PLC can align, synchronize, arrange, or otherwise coordinate the physical movement of the inner compartment, the light panels and the broadcasted audio information to provide the relative motion with accompanying audio information to the rider.

The images that are displayed can be represented by digital data that can be accessed by the computer readable instructions and stored in a database 168. The database can be in electronic communications with the computer readable instructions. The images can be changed and the display properties of the images changed by the computer readable instructions. In the event that the images wish to be changed or modified, an external data source, such as USB drive 170 can be connected to the computer or database and a new set of images displayed. The computer readable instructions can also be updated from a remote server 172 with a wired or wireless connection. In the event that the theme of the ride is changed, the images can be updated by updating the images database and the computer readable instructions Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A relative motion amusement ride comprising:

a rider's compartment carried by a trailer;

an inner compartment included in the rider's compartment;

a slewing assembly attached to the inner compartment configured to rotate a rider's area defined by the inner compartment;

a vertical motion assembly attached to the inner compartment and configured to allow the rider's area to travel vertically relative to the trailer;

an inner door carried by the inner compartment configured to allow access to the rider's area;

an outer door attached to the rider's compartment configured to allow access to the inner compartment;

a set of light panels disposed along an inner wall of the rider's compartment and along the perimeter of the rider's area configured to display images inward toward the rider's compartment;

a door light panel attached to the outer door configured to display images inward toward the rider's compartment;

a light panel controller in communications with a database of images and computer readable instructions for displaying images on the set of light panels and door light panel wherein such display is cooperatively associated with the motion of the rider's compartment to coordinating the physical movement of the inner compartment and the image on the light panels to provide relative motion to the rider;

an inner speaker carried by the rider's compartment for providing audio information in the rider's area wherein the audio information is coordinated with the physical movement of the inner compartment and the images on the light panels;

a microphone configured to receive audio information generated within the rider's area;

an outer speaker for broadcasting audio information recorded by the microphone;

an video camera configured to capture video information generated within the rider's area;

an attractor display carried by the trailer for projecting video information captured by the video camera external to the rider's compartment;

a set of extensions carried by the trailer; and, a set of coverings carried by the trailer and attached to the extensions to conceal at least a portion of the rider's compartment.

2. The apparatus of claim 1 including a transparent wall encircling the rider's area allowing riders to view the images on the light panels from the rider's area.

3. The apparatus of claim 1 including an entryway allowing riders to enter the rider's area.

4. The apparatus of claim 1 including a folding ramp allowing riders to enter the rider's area.

5. The apparatus of claim 1 including a vertical drive disposed beneath the inner compartment and extending through the rider's compartment to provide vertical motion to rider's area.

6. The apparatus of claim 1 wherein the vertical drive includes a worm gear.

7. The apparatus of claim 1 including a center post wherein the inner compartment travels vertically about the central post.

8. The apparatus of claim 1 including:

an inner microphone configured to capture audio information generated within the rider's area; and, an outer speaker carried by the trailer for broadcasting audio information captured by the inner microphone external to the rider's component.

9. The apparatus of claim 1 including a well included in a lower portion of the trailer wherein the rider's compartment is disposed in the well.

10. A relative motion amusement ride comprising:

an inner compartment carried by a trailer a configured to rotate about a central axis;

an inner door carried by the inner compartment configured to allow access to a rider's area included in the inner compartment;

a set of light panels encircling the inner compartment and disposed along the perimeter of the rider's area and configured to display images inward toward the rider's compartment;

a light panel controller in communications with a database of images and computer readable instructions for displaying images on the set of light panels and a door light panel wherein such display is cooperatively associated with the motion of the rider's compartment to coordinating the physical movement of the inner compartment and the image on the light panels to provide relative motion to the rider; and, a center post extending vertically through the inner compartment wherein the rider's compartment can rotate about the center post.

11. The apparatus of claim 10 including an inner speaker carried by the rider's compartment for providing audio information in the rider's area.

12. The apparatus of claim 11 including:

a light panel controller for controlling the images displayed on the light panels;

a drive controller for controlling the physical motion of the inner compartment; and, a computer system in communications with the light panel controller, a drive controller and inner speaker wherein the audio information is coordinated with the physical movement of the inner compartment and the image on the light panels.

13. The apparatus of claim 10 a set of extensions carried by the trailer; and, a set of coverings carried by the trailer and attached to the extensions to conceal at least a portion of the rider's compartment.

14. The apparatus of claim 10 including a ramp carried by the trailer.

15. The apparatus of claim 10 including:

an video camera configured to capture video information generated within the rider's area; and, an attractor display for projecting video information captured by the video camera external to the rider's compartment.

* * * * *